United States Patent [19]

Olive

[11] Patent Number: 4,497,124

[45] Date of Patent: Feb. 5, 1985

[54] STETHOSCOPE IDENTIFICATION BADGE

[75] Inventor: Jerrel W. Olive, Apex, N.C.

[73] Assignee: The Olive Company, Inc., Raleigh, N.C.

[21] Appl. No.: 507,042

[22] Filed: Jun. 23, 1983

[51] Int. Cl.[3] ..... A44C 3/00

[52] U.S. Cl. ..... 40/2 R; 40/1.5

[58] Field of Search ..... 40/2 A, 2 E, 303, 2 R, 40/314, 1.5, 316, 315; 181/126; 24/49 KC, 49 S, 119

[56] References Cited

U.S. PATENT DOCUMENTS 3,000,463 9/1961 Collins ..... 181/126

4,349,975 9/1982 Chubb ..... 40/2 A

*Primary Examiner*—Robert P. Swiatek

*Assistant Examiner*—Cary E. Stone

*Attorney, Agent, or Firm*—B. B. Olive .

[57] ABSTRACT

A badge for aid in identification of the owner of a particular stethoscope is removably mounted on the Y-connector of the stethoscope and comprises a pair of mated snap-fit cap pieces and with an identification portion thereon for bearing the owner's name.

1 Claim, 10 Drawing Figures

STETHOSCOPE IDENTIFICATION BADGE

DESCRIPTION

1. Technical Field

The invention relates to badges and particularly to a badge suited for attachment to a stethoscope and which is adapted to bear the owner's name for ownership identification purposes.

2. Background Art

Stethoscopes of the type having a pair of ear pieces connected by tubes through a Y-connector to a tube leading to a sound pickup head are widely employed by doctors, nurses, physicians' assistants, technicians and others. A common problem is that of identifying a particular stethoscope as belonging to a particular person. One practice has been to write the owner's name on tape and secure the tape at some point to the stethoscope. Another practice has been to use a hospital-type patient identification band attached to the stethoscope with the owner's name on the band.

Thus, the object of the invention is that of providing a device adapted to be releasably secured to a stethoscope for service as an identification badge to signify the owner of the stethoscope.

DISCLOSURE OF INVENTION

A stethoscope identification badge device according to the invention comprises a pair of snap-fitted pieces which mount on the stethoscope Y-connector and which also provides means for bearing the owner's name for identification purposes.

BEST MODE FOR CARRYING OUT THE INVENTION

Figure 1:
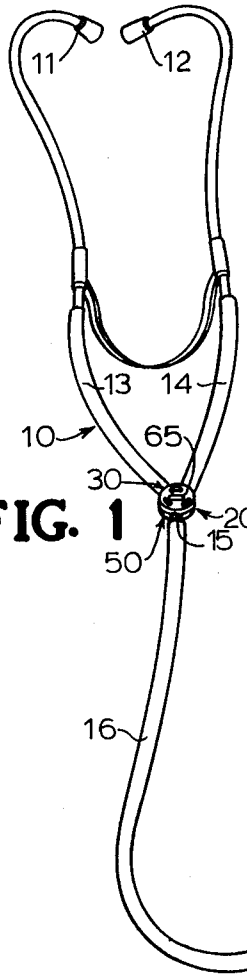
FIG. 1 is a pictorial view illustrating a conventional stethoscope employing an identification badge of the present invention.
Figure 6:
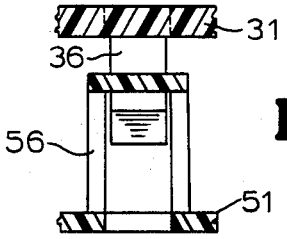
FIG. 6 is a fragmentary section view taken substantially aong lines 6—6 of FIG. 5.
Figure 7:
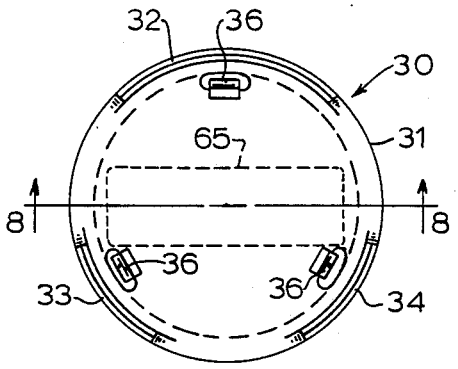
FIG. 7 is a reduced scale plan view of the interior of the top piece employed by the stethoscope identification badge of the invention.
Figure 8:
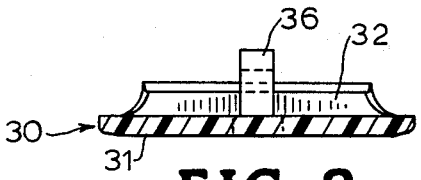
FIG. 8 is a section view taken substantially along line 8—8 of FIG. 7.
Figure 9:
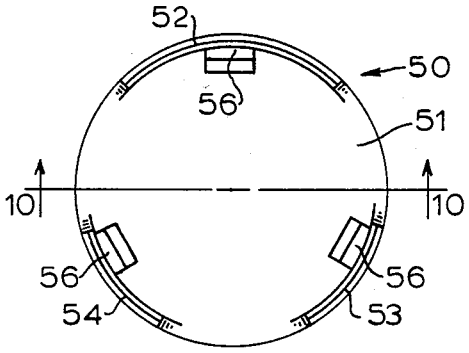
FIG. 9 is a reduced scale plan view of the interior of the bottom piece employed by the stethoscope identification badge of the invention.
Figure 10:
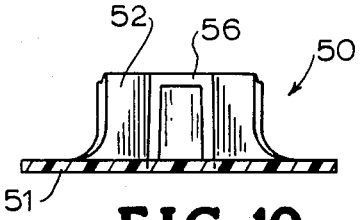
FIG. 10 is a section view taken substantially along line 10—10 of FIG. 9.

Referring first to FIG. 1, a stethoscope of the type with which the invention device may be employed is generally numbered 10. Stethoscope 10 has a pair of ear pieces 11, 12; tubes 13, 14 which connect ear pieces 11, 12 to Y-connector 15; and tube 16 connecting Y-connector 15 to a sound pickup head 17. Stethoscope identification badge 20, the object of the present invention, is illustrated in FIG. 1 as being mounted on Y-connector 14 of stethoscope 10 in a snap-fit manner. Badge 20 comprises a top cap piece 30 and a bottom cap piece 50 which when in use are snap-fitted together in a locked relationship on Y-connector 15 as illustrated in FIG. 1.

Figure 4:
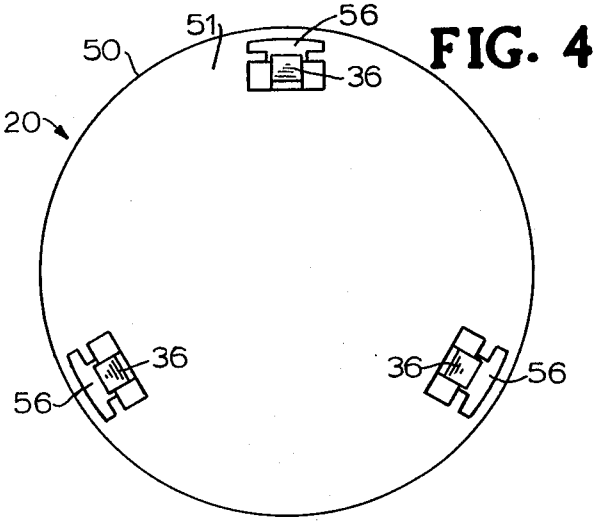
FIG. 4 is a bottom plan view of the stethoscope identification badge of FIG. 2.
Figure 5:
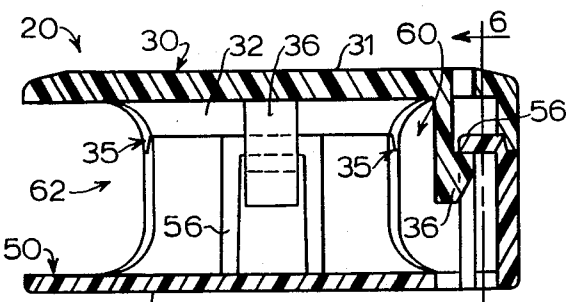
FIG. 5 is a section view taken substantially along line 5—5 of FIG. 2.
Figure 2:
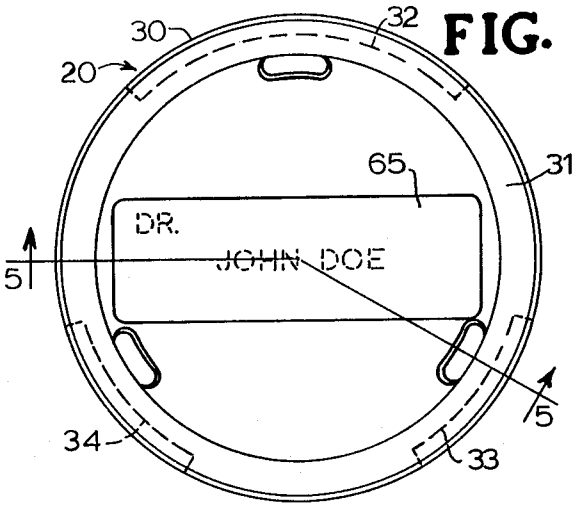
FIG. 2 is a top plan view of an assembled stethoscope identification badge of the present invention.
Figure 3:
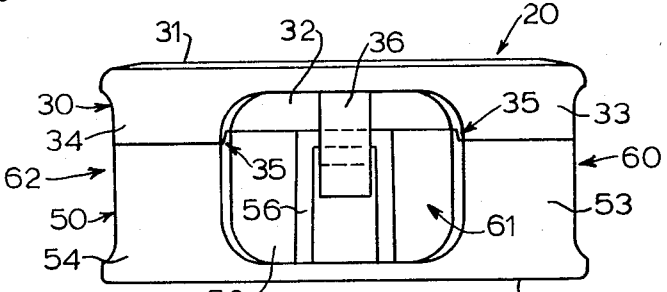
FIG. 3 is a side elevation view of the stethoscope identification badge of FIG. 2.

Top cap piece 30 has a top wall 31 and three side wall portions 32, 33, 34. Likewise, bottom cap piece 50 has a bottom wall 51 and three side wall portions 52, 53, 54. As best seen in FIG. 3, top wall 31 and bottom wall 51 oppose each other with side walls 32, 52 mating together; side walls 33, 53 mating together; and with side walls 34, 54 mating together. As best seen in FIGS. 3 and 5, wall portions 32 through 34 and 52 through 54 have mating ledges generally numbered 35. As illustrated, wall portions 32, 52 are approximately twice the width of wall portions 33, 53 and 34, 54. This arrangement assists in proper alignment of top cap 30 and bottom cap 50.

The previously referred to snap-fit arrangement is accomplished with integrally molded tabs 36 protruding downwardly and inwardly from top wall 31 and with tab locking retainers 56 molded integral with bottom wall 51 and extending upwardly or inwardly. Tabs 36 snap-fit into tab locking retainers 56. Thus, top cap piece 30 and bottom cap piece 50 are maintained in a locked together or snap-fit relationship. When top cap piece 30 and bottom cap piece 50 are snapped together, openings 60, 61 and 62 are formed between the mated side wall portions 32, 52 and 33, 53; between the mated sidewall portions 33, 53 and 34, 54; and between the mated sidewall portions 34, 54 and 32, 52 respectively. Openings 60, 61 and 62 receive the legs of Y-connector 15 and thus allow top cap piece 30 and bottom cap piece 50 to be snap-fitted together over the legs.

Referring back to top wall 31 of top cap piece 30, an external writing surface 65 is provided whereupon the owner's name may be written for identification purposes. It is also anticipated that the use of color coding may be employed to help in identification or distinguishing between doctors, nurses, physicians' assistants, technicians and others, i.e., all doctors would have blue badges, all nurses would have yellow badges, et cetera, in addition to their own name for identification.

What is claimed is:

1. A stethoscope apparatus, comprising:

(a) a pair of ear pieces;

(b) a sound pickup piece;

(c) a Y-connector and tubing connecting the ear pieces to the pickup piece through the Y-connector; and (d) an identification badge comprising:

(i) a structure formed of mated top and bottom cap pieces fitted to the Y-connector on opposite sides thereof with the legs of said Y-connector passing through apertures in sidewall portions of said pieces, each aperture being formed between the mated sidewall portions of said cap pieces;

(ii) securing means comprising portions of said top and bottom cap pieces snap-fitted together in a mating relationship under applied manual pressure to force the pieces together to maintain the pieces in securement on said Y-connector; and (iii) a selected outer surface portion of at least one of said pieces being adapted to receive name indicia thereon.

* * * * *